US008145404B2

(12) United States Patent
Gauthier et al.

(10) Patent No.: US 8,145,404 B2
(45) Date of Patent: Mar. 27, 2012

(54) METHOD FOR SYNCHRONIZING AN OIL CONTROL VALVE AS A VIRTUAL CHECK VALVE

(75) Inventors: Daniel G. Gauthier, Clarkston, MI (US); Jeffrey M. Pfeiffer, Frankenmuth, MI (US)

(73) Assignee: Delphi Technologies, Inc., Troy, MI (US)

( * ) Notice: Subject to any disclaimer, the term of this patent is extended or adjusted under 35 U.S.C. 154(b) by 866 days.

(21) Appl. No.: 12/228,715

(22) Filed: Aug. 15, 2008

(65) Prior Publication Data

US 2010/0042306 A1 Feb. 18, 2010

(51) Int. Cl.
*G06F 19/00* (2006.01)
*F01M 1/18* (2006.01)
*F01M 11/10* (2006.01)

(52) U.S. Cl. ..... 701/102; 184/6.4; 123/196 S

(58) Field of Classification Search ..... 701/102–103, 701/110, 111, 114, 105; 123/90.15–90.17, 123/90.33, 90.34, 196 R, 196 S; 73/114.56, 73/114.57; 184/6.4, 6.5
See application file for complete search history.

(56) References Cited

U.S. PATENT DOCUMENTS

| | | | | |
|---|---|---|---|---|
| 6,758,184 | B1 * | 7/2004 | Lee et al. | 123/196 R |
| 6,883,481 | B2 * | 4/2005 | Gardner et al. | 123/90.17 |
| 6,935,290 | B2 * | 8/2005 | Jiang | 123/90.17 |
| 6,941,799 | B2 * | 9/2005 | McCabe | 73/114.26 |
| 6,955,145 | B1 * | 10/2005 | McCabe et al. | 123/90.15 |
| 7,000,580 | B1 * | 2/2006 | Smith et al. | 123/90.17 |
| 7,603,224 | B2 * | 10/2009 | Aldrich et al. | 701/103 |
| 2007/0175425 | A1 | 8/2007 | Berndorfer | |
| 2008/0135004 | A1 * | 6/2008 | Simpson et al. | 123/90.17 |
| 2008/0172160 | A1 * | 7/2008 | Jiang et al. | 701/51 |
| 2008/0281496 | A1 * | 11/2008 | Brennan et al. | 701/102 |
| 2010/0059240 | A1 * | 3/2010 | Schmidt | 173/1 |

* cited by examiner

*Primary Examiner* — Willis Wolfe, Jr.
*Assistant Examiner* — Johnny Hoang
(74) *Attorney, Agent, or Firm* — Thomas N. Twomey

(57) ABSTRACT

A standard cam phasing OCV may be employed as a virtual check valve to choke the backflow of oil during negative cam torque conditions, including execution of a duty cycle command in an event-based manner. Normally, OCV duty cycle commands are made on a time basis, but for VCV the duty cycle output change must be synchronized with engine events. A method is disclosed for calculating and delivering the VCV duty cycle so that both time-based and event-based controls are maintained and work together. Phase alignment of response time of the OCV solenoid is based upon cam target wheel edges and is event-based. An initial phase rate vs. phase angle is monitored by the Engine Control Module (ECM). Adjustment of the phase angle is provided to achieve maximum cam position phase rate.

16 Claims, 6 Drawing Sheets

METHOD FOR SYNCHRONIZING AN OIL CONTROL VALVE AS A VIRTUAL CHECK VALVE

TECHNICAL FIELD

The present invention relates generally to an oil flow control valve for a camshaft phaser; more particularly, to the operation of an oil flow control valve (OCV) as a virtual check valve (VCV) against undesired back flow of oil from a camshaft phaser during camshaft torque reversal events; and most particularly to a method for synchronizing the actuation of such an oil control valve as a VCV.

BACKGROUND OF THE INVENTION

Camshaft phasers (also referred to herein as "cam phasers") are used to control the angular phase relationship of a camshaft to a pulley or sprocket driven by a crankshaft of an internal combustion engine. A variable cam phaser (VCP) allows changing the phase relationship while the engine is running. Typically, a VCP is used to phase shift an intake cam on a dual cam engine to broaden the torque curve of the engine, to increase peak power at high revolution speeds, and to improve the idle quality. Also, an exhaust cam can be phase shifted by a cam phaser to provide internal charge dilution control, which can significantly reduce HC and NOx emissions, and/or to improve fuel economy. The above objectives are known in the art as "combustion demands". With this definition, a VCP is used to account for combustion demands of an internal combustion engine.

Cam phasers typically are either "vane-type" or "spline-type" and are controlled by hydraulic systems that use pressurized lubrication oil from the engine. An "advance" or "retard" position of the camshaft is commanded via an oil flow control valve (OCV) that controls the oil flow to different ports entering a VCP. A typical OCV is a spool valve comprising a spool slidably disposed in a cylindrical body, the spool being driven by attachment to an electrical solenoid, and the position of the spool within the body serving to open and close appropriate porting in the body connected to the VCP ports.

A known problem in cam phaser operation is that valve-opening and valve-closing events of a camshaft can give rise to torque reversals resulting in pressure peaks in the oil contained in the chambers of the VCP, which peaks can be higher than the oil control supply pressure, i.e., the oil pressure supplied by the engine. The camshaft experiences a measurable resistance to rotation as a cam follower climbs the opening ramp of each cam lobe; and similarly, a measurable assistance to rotation as the cam follower descends the closing ramp. Thus, the measurable torque on the camshaft follows a predictable variation, the amplitude and frequency (period) of which are governed by the particular size and shape of an engine's cam lobes, drive train kinematics and the number of cylinders.

This phenomenon can lead to a certain amount of undesired reverse oil flow out of the phaser, diminishing the phasing performance of the cam phasing system by causing the rotational position of the phaser rotor within the phaser stator to be changed. This problem is exacerbated by any air bubbles in the oil supply system, which act as pneumatic cushions preventing hydraulic rigidity, and further by conditions of high oil temperature and/or low oil pressure such as may be experienced by an engine under heavy load and thermal stress.

To avoid such reverse oil flow under the above mentioned circumstances, it is known in the art to employ a check valve (CV) in the oil supply passage of either the cylinder head or the crankcase. Such a check valve also ensures that the cam phaser does not empty out in cases when the oil pressure is reduced, for example when the engine is stopped. However, this approach adds significant cost to the cylinder head or engine block. Also, the implementation of the check valve can be difficult because of oil routing. Further, the check valve should not be placed too far away from the cam phaser in order to be effective. Perhaps most important, a mechanical check valve itself acts as a flow restriction in the allowed direction of oil flow, thus diminishing the inherent phasing rate (response rate) performance of a cam phaser system.

Another approach, as disclosed in Published US Patent Application No. 2007/0175425, published Aug. 2, 2007, the relevant disclosure of which is incorporated herein by reference, is to vary the action of the solenoid driving the OCV to effectively block such reverse flow by appropriate positioning of the OCV spool within the valve body. The OCV can be cycled full on and full off (preferably "dithered" at an intermediate spool position by application of an AC signal to the solenoid) in synchronization with cam torque reversals, which function serves to accept all positive hydraulic power into the VCP, which enhances the phasing rate, while rejecting all negative hydraulic power, which diminishes the phasing rate, thus effectively rectifying oil pressure in the VCP. The OCV thus can function as a "virtual check valve" (VCV) when a constant phase angle of the rotor is desired, allowing omission of an additional mechanical check valve, in addition to its nominal function of providing oil selectively to the advance and retard ports of the phaser when a change in phase angle is desired.

The required frequency of OCV activation is readily calculated from the engine speed and the number of engine cylinders as follows:

$$F_{Hz}=(\text{RPM}\times\#\text{ of cylinders})/120 \quad \text{(Eq. 1)}$$

However, correct synchronization timing between OCV spool motions and cam torque reversals has been not at all easy to accomplish in the prior art, nor is a method for accurate synchronization disclosed in detail in the incorporated reference.

What is needed in the art is a method for providing accurate synchronization between OCV spool motion and cam torque reversals in an internal combustion engine to effectively block oil flow reversals from a camshaft phaser during camshaft torque reversals.

It is a principal object of the present invention to improve operation of a camshaft phaser and of an engine incorporating a camshaft phaser.

SUMMARY OF THE INVENTION

Briefly described, US Patent Application No. 2007/0175425, published Aug. 2, 2007, discloses how a standard cam phasing OCV may be commanded between two spool positions to choke the reverse flow of oil through the valve during negative cam torque conditions. A critical part of the VCV concept is the execution of a duty cycle command in an event-based manner. Normally, duty cycle commands to the OCV are made on a time basis, but for VCV, the duty cycle output change must be synchronized with engine events. The present invention is directed to a method for calculating and delivering the VCV duty cycle so that both time-based and event-based controls are maintained and work together. Phase alignment of electromechanical response time of the OCV and solenoid is based upon cam target wheel edges and therefore is event-based. An initial phase rate vs. phase angle is calculated and monitored by the Engine Control Module (ECM), and adjustment of the phase angle is provided by a self-learning algorithm to achieve maximum cam position phase rate.

BRIEF DESCRIPTION OF THE DRAWINGS

The present invention will now be described, by way of example, with reference to the accompanying drawings, in which.

DESCRIPTION OF THE PREFERRED EMBODIMENTS

As disclosed in the incorporated published patent application, reverse flow on account of the pressure ratio on the output side of the OCV and a corresponding input side can be prevented by synchronizing the movement of the OCV spool with oil pressure characteristics on the output side of the OCV, such synchronization resulting in the spool's being moved to a position where the OCV's oil ports are closed once the oil pressure on the output side of the OCV is too high for feeding oil to the cam phaser, and in the spool's being moved to a position where the oil ports are open once the oil pressure on the output side of the OCV allows for feeding oil to the cam phaser.

Note that such movement control may be applied to either or both of the phase-advance and phase-retard supply/return ports of a camshaft phaser. In a presently preferred embodiment of a method in accordance with the present invention, the spool is positioned at an intermediate location within the valve body to close both ports, thus capturing a hydraulically rigid, incompressible oil volume within the phaser stator and thereby assuring against any movement of the rotor within the stator.

Further, rather than sensing the required oil pressures directly, the torque reversals during camshaft rotation can be predicted from knowledge of the camshaft position with respect to the crankshaft rotational cycle. Thus, all that is required is to monitor the camshaft position, which typically is indicated in a prior art engine via a camshaft target wheel or other such rotary encoder.

The correct phasing of the cyclic pair of cam torque and OCV spool motion as a VCV is the subject of the present invention.

Figure 1:
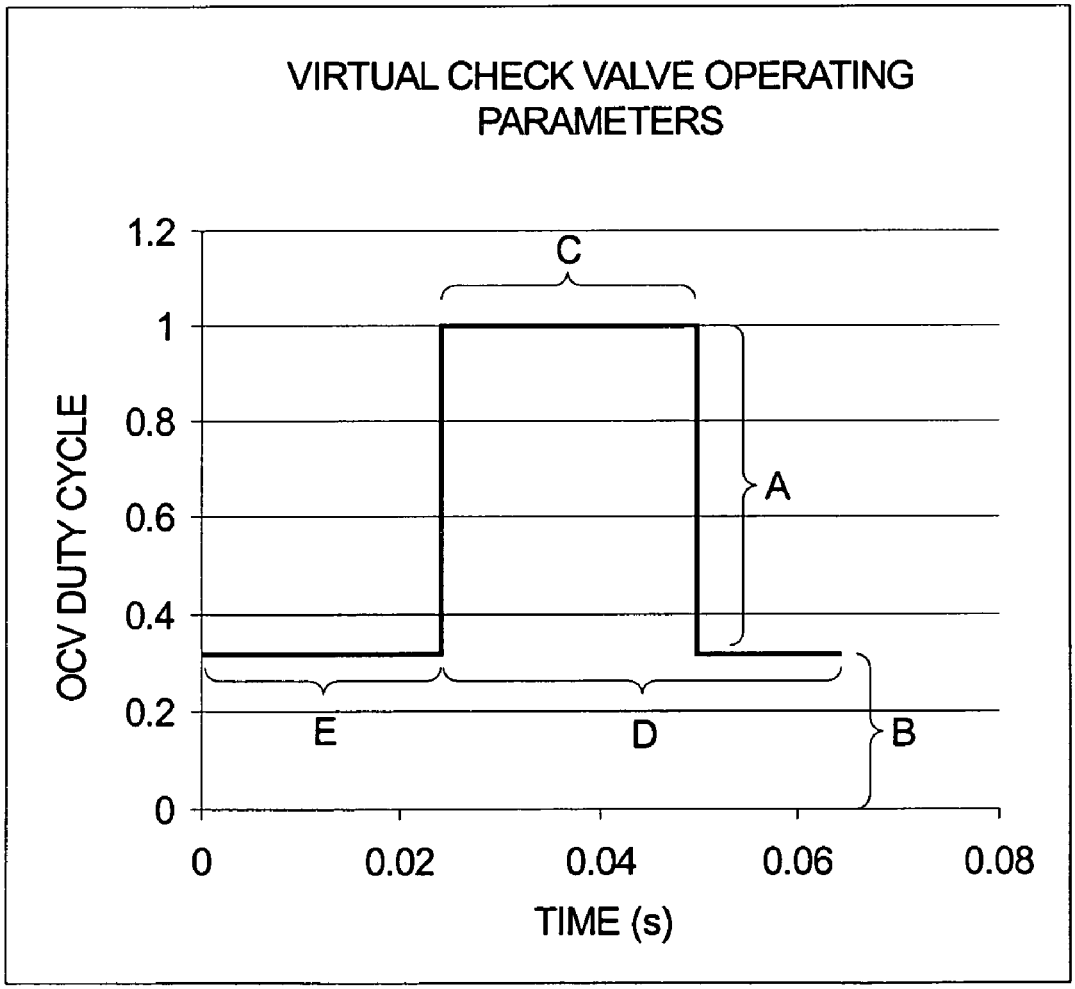
FIG. 1 is a graph showing the operating parameters for an exemplary virtual check valve.

Referring to FIG. 1, various operating parameters are shown for an exemplary virtual check valve in accordance with the present invention. A is the amplitude (0.68%) of the OCV duty cycle above the duty constant B (O.32%). C is the pulse width (65%) of the duty cycle. D is the period (0.04 seconds) of the duty cycle. E is the phase delay (0.025 seconds).

Characterizing the electrical response time of an electrical solenoid device is a well-established science. This technique results in defining a mechanical spool motion versus time when its electrical coil is energized with an electrical impulse.

Figure 2:
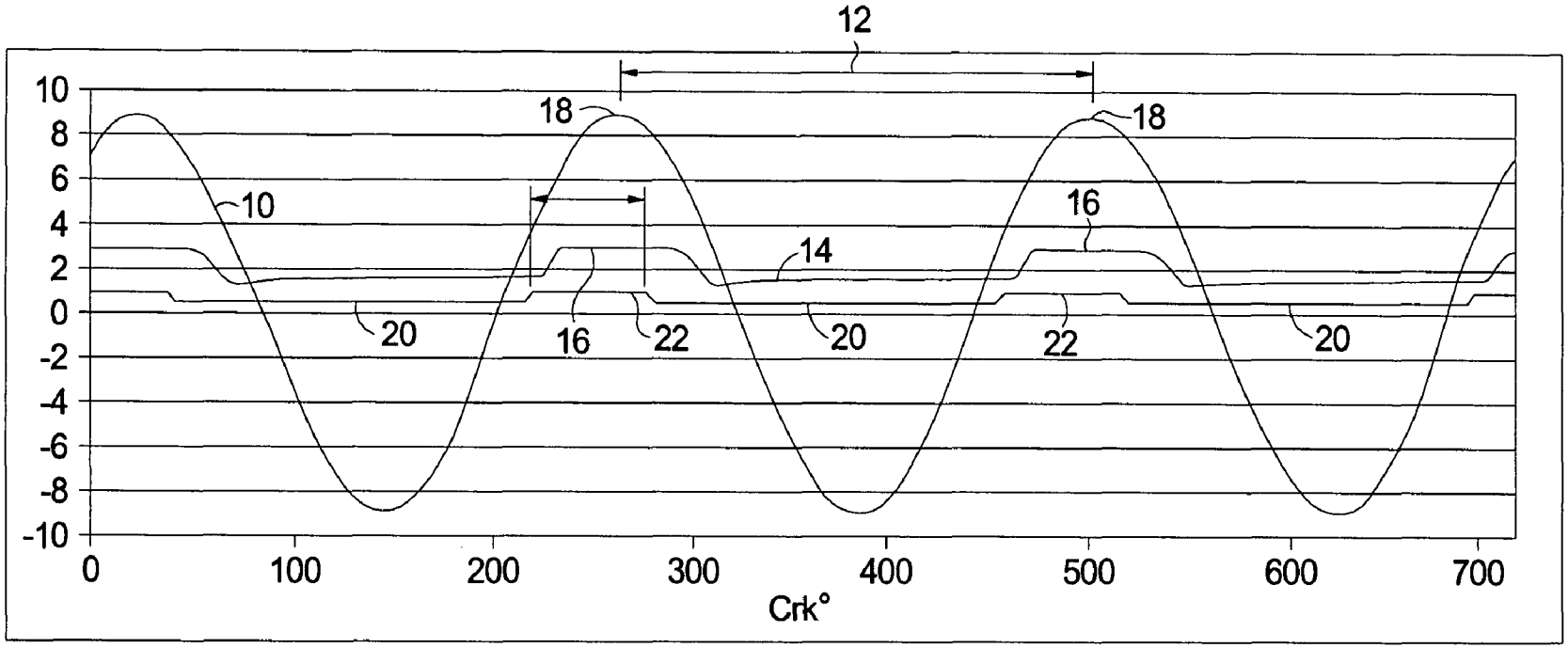
FIG. 2 is a graph of a full engine cycle (two crankshaft turns) illustrating definitions of cam torque cycle, percent of period that the OCV activation is full on (OCV duty cycle %=1), and period of cam torque reversal frequency.

Referring to FIG. 2, the terminology of the present invention is further defined. Curve 10 is the torque curve for an individual cam lobe of an engine camshaft of a V-6 engine, the period 12 of the curve being ⅓ of two rotations (720°) of the crankshaft, or 240°. The time length of period 12 is the reciprocal of the torque reversal frequency $F_{Hz}$ as expressed above in Equation 1. In the spool position curve 14, ideally the spool position 16 that counters the maximum torque reversal 18 is centered under the point of maximum reversal 18. The OCV activation curve is expressed as 0% duty cycle portions 20 and 100% duty cycle portions 22. Note that duty cycle portions 22 anticipate slightly the desired spool positions, and also note that the spool position is maintained for some time after the OCV is electrically deactivated. This is because of lag in both directions. In one known OCV, this lag amounts to about 8 mseconds in the activation direction and about 25 mseconds in the deactivation direction.

Figure 3:
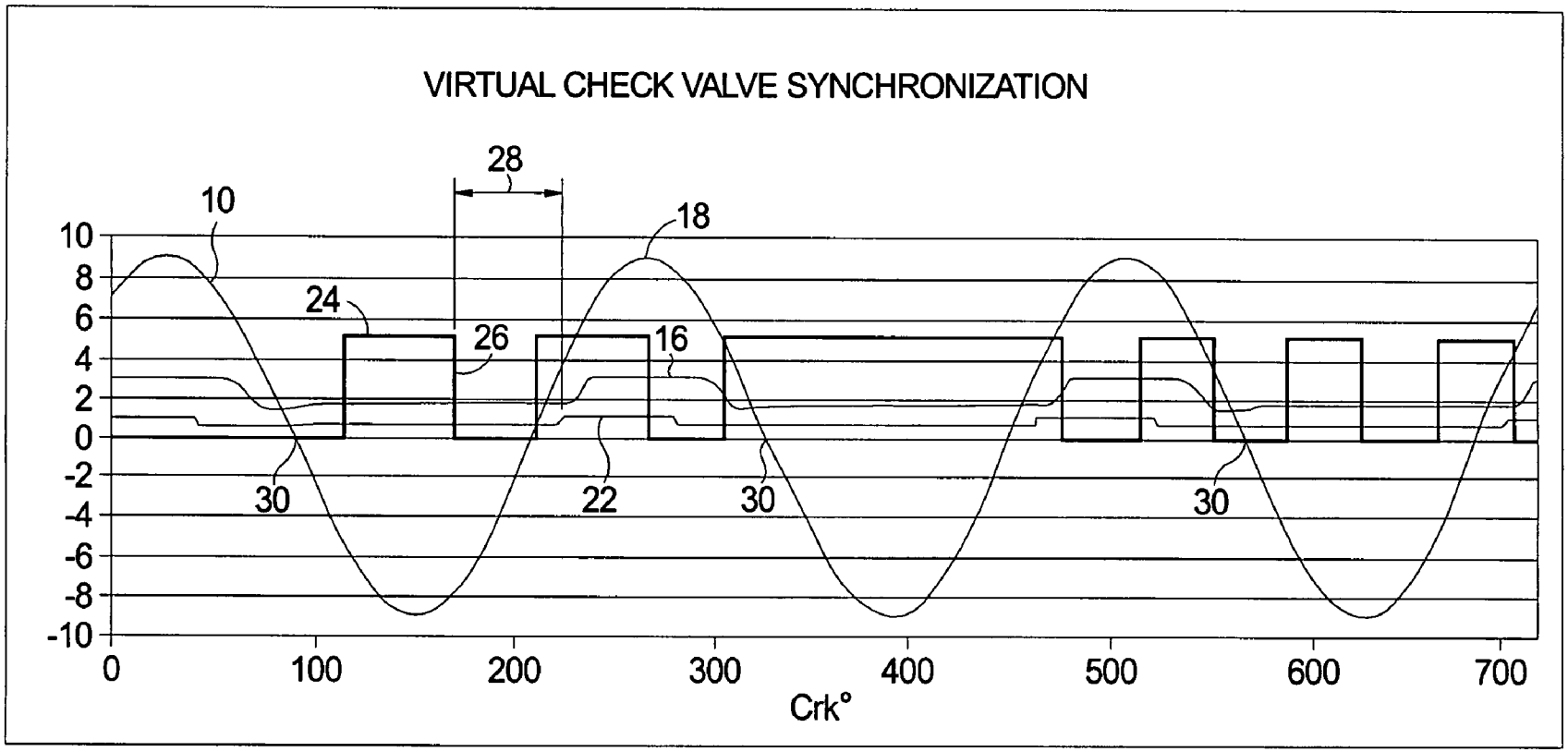
FIG. 3 is a graph showing a typical synchronization between OCV activation, cam target wheel, and cam torque.

Referring to FIG. 3, the synchronization timing is added to the curves shown in FIG. 2. Square wave 24 is the electrical signal resulting from sensing of a tooth edge or other signal-generating means of a camshaft target wheel or other encoder as is well known in the automotive arts. Instead of measuring the camshaft torque directly, the target wheel signal is directly and consistently indicative of the angular position of the camshaft and therefore of the torque curve, as noted above. At a designated rotary event defined by change 26 in this signal, which may be either rising or falling, a time-based offset 28 is performed which is based upon the speed of the engine, after which activation 22 of the OCV solenoid is initiated as described above to drive the OCV spool to a position 16 blocking the appropriate port(s) of the spool valve, as described and illustrated in the incorporated reference, during the peak 18 of the torque reversal 10. The OCV thus is made to function as a virtual check valve during torque reversals in accordance with the invention.

It has been found that the impact of torque reversals is most severe under conditions of low oil pressure and/or low oil viscosity. These conditions typically correspond to engine speeds of less than about 1000 rpm and/or engine oil temperatures in excess of about 110° C. Fortuitously, a current-technology OCV cannot respond rapidly enough for VCV operation at engine speeds much above 1000 rpm, and attempts to use it under such adverse conditions can actually worsen the apparent torque reversals through incorrect timing of the OCV duty cycle.

Figure 4:
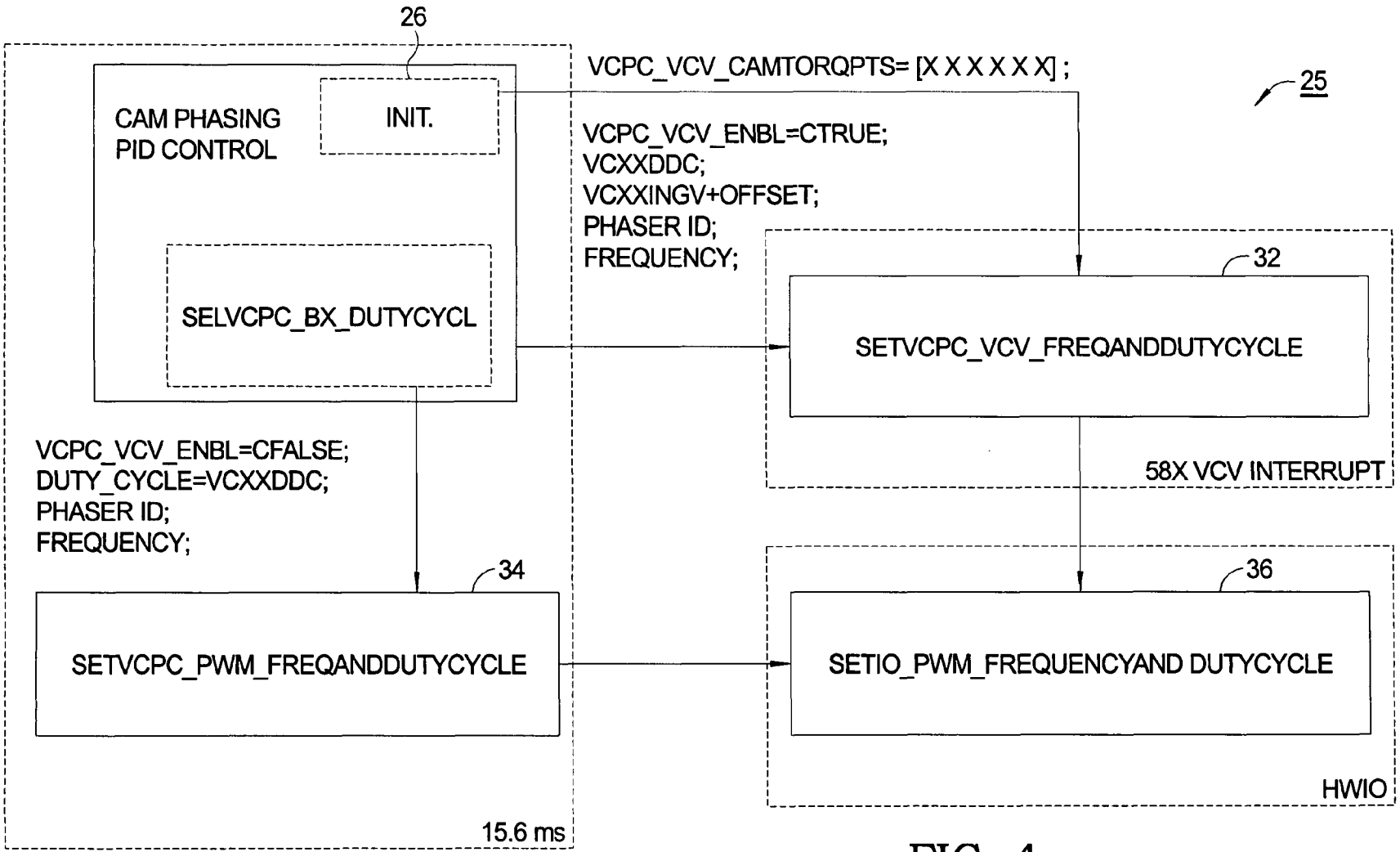
FIG. 4 is a schematic flow diagram showing structure of a duty cycle calculation and command in accordance with the present invention.

Referring now to FIGS. 3 and 4, the structure of the duty cycle calculation and command in accordance with the present invention is shown. The sequence and description of this control 25 is as follows:

1. At initialization, the switch points 30 in crank angle, defined as the points in crank angle where cam torque changes from positive to negative, are determined from calibration settings. The calibrations define the location of key cam torque events as a function of engine speed (RPM). These switch points will call the SetVCPC_VCV_FreqAndDutyCycle function 32 by an interrupt 26 scheduled on a target wheel tooth or by a timer.
2. When RPM conditions are met (preferably less than about 1000 rpm), the SetVCPC_VCV_FreqAndDuty- Cycle function will set the duty cycle between the normal PID duty cycle (VCXXDDC), which is non-VCV for positive cam torque, and an adjusted integral duty cycle (VCXXINGV+offset), for negative cam torque. The adjustment is based on the expected choked-flow duty cycle, which is a function of valve temperature. The offset is determined based on the integral duty cycle and the expected choked-flow duty cycle, to ensure rationality between the two (i.e. the integral duty cycle should not be less than the choked-flow duty cycle). If this occurs, a default offset shall be used. The SetVCPC_PWM_FreqAndDutyCycle function 34 is bypassed for this case.

3. When RPM conditions are not met, the SetVCPC_VCV_FreqAndDutyCycle function returns immediately. In this case, SetVCPC_PWM_FreqAndDutyCycle is executed as normal.
4. The function SetIO_PWM_FrequencyAndDutyCycle 36 is called from either SetVCPC_PWM_FreqAndDutyCycle or SetVCPC_VCV_FreqAndDutyCycle. SetIO_PWM_FrequencyAndDutyCycle is the function that delivers the final duty cycle to the valve.
5. Conditions for enabling VCV are determined at a time-based rate of 15.6 ms.
6. PID duty cycle is determined at a time-based rate of 15.6 ms, regardless of VCV operation.
7. Determination and delivery of the VCV duty cycle is at an engine-event-based rate, driven by interrupts at the crank-angle locations determined in step 1.

Figure 5:
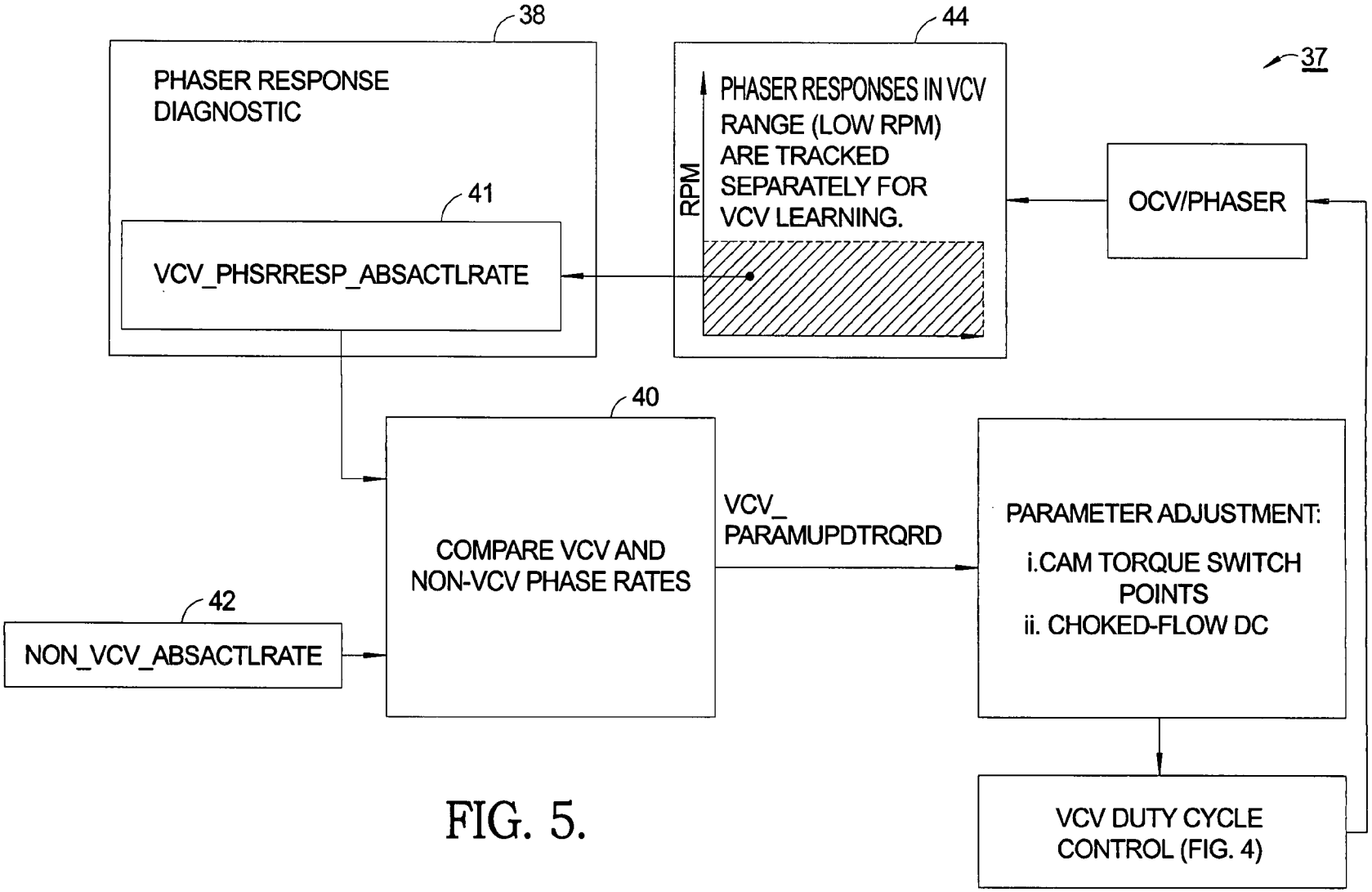
FIG. 5 is a schematic flow diagram showing structure of the switch point learning function.

Preferably, a PID/VCV control system in accordance with the present invention can analyze its own performance and automatically improve upon and maximize it (known in the art as "learning"). Referring to FIG. 5, the structure of such switch point learning is shown. This algorithm 37 observes the phase rate that is achieved by the VCV operation, and uses a comparison to adjust the torque switch points and the choked-flow duty cycle, since these parameters contain uncertainty.

The following describes the sequence of VCV learning:

1. The phaser response diagnostic 38 (an existing diagnostic that measures real-time phasing rate) continuously monitors phasing control. Phasing responses that are captured in the VCV operating range (i.e. low RPM) are delivered separately to a VCV learning function.
2. The VCV learning function consists of two steps:

a) compare 40 the measured VCV phase rate 41 with the non-VCV phase rate 42, which is stored in calibration. If the VCV measured phase rate is found to be less than the non-VCV phase rate, VCV parameter update is required (VCV_ParamUpdtRqrd=TRUE). The VCV phase rate may be required to exceed the non-VCV phase rate by a calibratible amount.

b) To improve VCV phase rate, there are four parameter update options:

i) Shift cam torque switch points to advance.

ii) Shift cam torque switch points to retard.

iii) Shift choked-flow duty cycle higher (toward 100%).

iv) Shift choked-flow duty cycle lower (toward 0%).

The magnitude of each parameter adjustment is calibratible. The parameter update function attempts each of these steps in turn. When a parameter update adjustment has been made, no further adjustments can be made until new VCV phase rate data are available. The effect of the parameter adjustment must be observed through the phaser response diagnostic 44, with new sample data generated. A minimum number of data points are required to assess the success or failure of the parameter adjustment.

If the parameter adjustment is determined to be successful (i.e. phase rate was increased), then that parameter adjustment is retained. If the phase rate is still less than the non-VCV phase rate, then that same parameter adjustment technique is repeated until the VCV phase rate is improved beyond the non-VCV phase rate, or until it reaches the desired excess defined in a).

If the parameter adjustment is not successful (i.e. no improvement in phase rate), then the parameter adjustment is eliminated and the next option is exercised. Each parameter adjustment must be confirmed by new data from the phaser response diagnostic, in the VCV range.

TABLE 1

Phasing Rates (Crank angle degrees per second)

| | 1<br>1000 RPM<br>120° C.<br>0% Air | 2<br>750 RPM<br>120° C.<br>0% Air | 3<br>750 RPM<br>150° C.<br>5% Air |
|---|---|---|---|
| Virtual Check Valve System | 83 | 76 | 56 |
| Mechanical Check Valve System | 96 | 76 | 59 |
| No Check Valve, 100% OCV Duty Cycle | 94 | 61 | 39 |

Referring now to Table 1, phasing rates are shown for three different engine operating conditions, illustrating the benefits and limitations of the use of a VCV.

Condition 1 is an engine having a hydraulically rigid (air-free) oil supply system, operating at a medium speed near the upper end of an acceptable thermal range. It is seen that a mechanical check valve provides only marginal improvement in phase rate over a non-check valve system, and that the VCV system is inferior. This is because the limit of electromechanical response of the OCV has been reached.

Condition 2 is an engine having a hydraulically rigid (air-free) oil supply system, but operating at a lower speed, again near the upper end of an acceptable thermal range. It is seen that both a mechanical check valve and a VCV provide significant improvement in phase rate over a non-check valve system. This is because the oil pressure, being a function of engine speed, is sufficiently low that cam torque reversals have a significant impact on performance in a non-checked system.

Condition 3 is the same as Condition 2 except that the operating temperature is raised from 120° C. to 150° C. and the oil system contains 5% air. It is seen that the use of either form of check valve is a distinct improvement over a non-checked system because the combined deleterious effects of high temperature, low oil pressure, and hydraulic non-rigidity are at least partially overcome.

Figure 6:
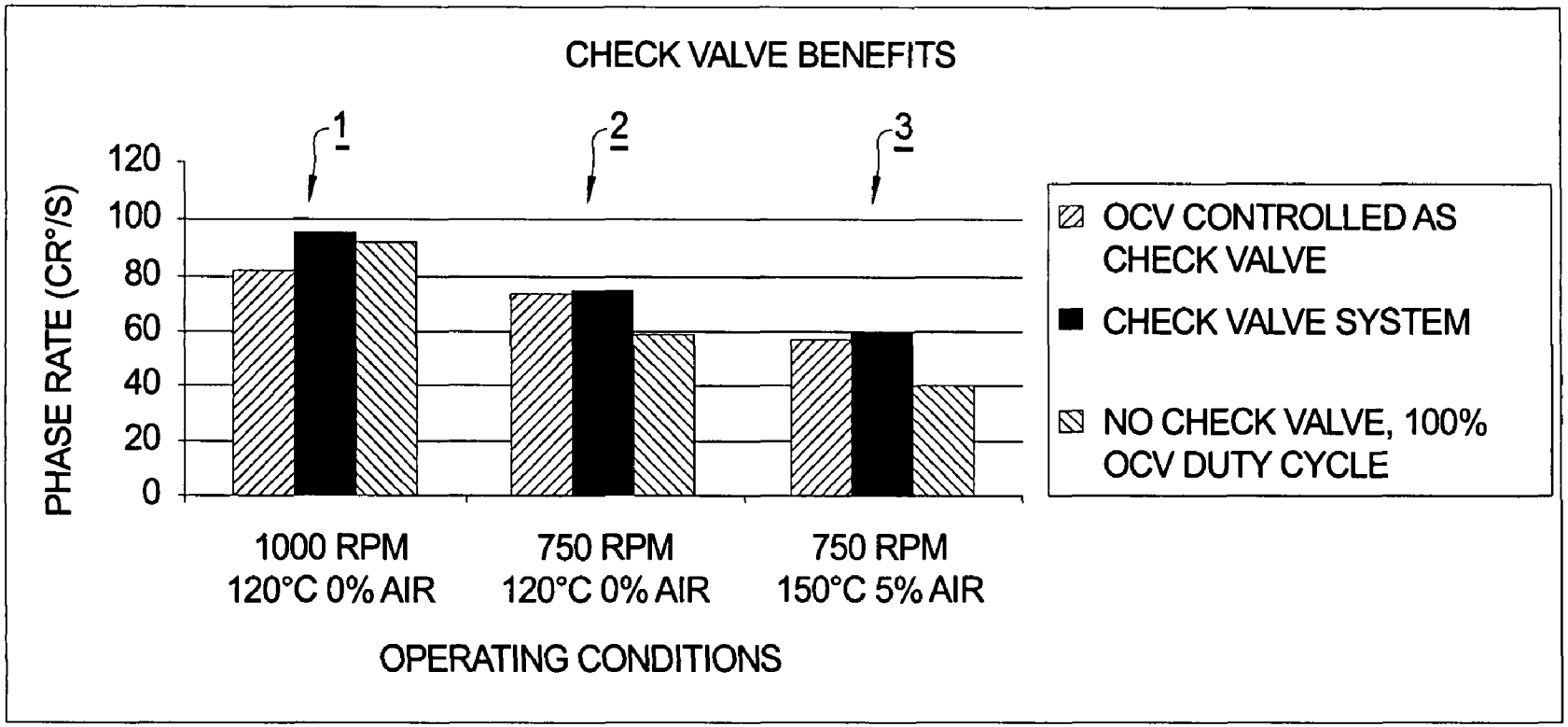
FIG. 6 is a graph showing the operating benefit provided by a virtual check valve when operated in accordance with the present invention.

These results also are shown graphically in FIG. 6.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for operating a solenoid-actuated oil control valve as a virtual check valve for preventing reverse flow of oil from an oil channel of a camshaft phaser during camshaft torque reversals, comprising the steps of:

a) providing a target event in a torque reversal curve of said camshaft phaser;

b) initiating a delay period at said target event; and c) energizing a solenoid of said solenoid-actuated oil control valve at the end of said delay period for a first time period to cause said solenoid-actuated oil control valve to occlude said oil channel during a second time period in which said reverse flow of oil would otherwise occur.

2. A method in accordance with claim 1 wherein said energizing step occurs at an end of said initiating step.

3. A method in accordance with claim 1 further comprising the steps of:

a) determining a phase relationship of said camshaft torque reversal curve to a signaling device external to said camshaft phaser; and b) initiating said delay period upon a signal from said signaling device.

4. A method in accordance with claim 1 wherein said oil channel is an advance oil channel.

5. A method in accordance with claim 1, wherein said solenoid-actuated oil control valve includes a spool connected to said solenoid and slidably moveable within a body to various positions within said body, and wherein said solenoid is actuated by a signal from an electronic controller.

6. A method in accordance with claim 5, wherein a one of said various positions causes said oil control valve to occlude said oil channel, and wherein said spool is maintained in said one position during said time period in which said reverse flow of oil would otherwise occur by operating said solenoid at a duty cycle.

7. A method in accordance with claim 6, wherein said duty cycle is a first duty cycle, and wherein definition of said one position is optimized by maximizing phase rate of said camshaft phaser.

8. A method in accordance with claim 7 wherein said maximizing phase rate is carried out by iterative adjustment of at least one operating parameter selected from the group consisting of advancing cam torque switch point, retarding cam torque switch point, increasing duty cycle, and decreasing duty cycle.

9. A method in accordance with claim 1 wherein said method is operative only within predetermined limits of engine speed.

10. A method in accordance with claim 9 wherein said engine speed is less than about 1000 rpm.

11. A method in accordance with claim 1 wherein said method is operative only within predetermined limits of oil temperature.

12. A method in accordance with claim 11 wherein said oil temperature is greater than about 110° C.

13. A method in accordance with claim 1 wherein said method is operative only within predetermined limits of engine speed and oil temperature.

14. A method in accordance with claim 13 wherein said engine speed is less than about 1000 rpm and said oil temperature is greater than about 110° C.

15. An internal combustion engine comprising a camshaft phaser connected to a solenoid-actuated oil control valve operable as a virtual check valve for preventing reverse flow of oil from an oil channel of said camshaft phaser during camshaft torque reversals in accordance with a method including the steps of providing a target event in a torque reversal curve of said camshaft phaser, initiating a delay period at said target event, and energizing a solenoid of said solenoid-actuated oil control valve at the end of said delay period for a first time period to cause said solenoid-actuated oil control valve to occlude said oil channel during a second time period in which said reverse flow of oil would otherwise occur.

16. A method in accordance with claim 1 wherein said energizing step occurs at an end of said initiating step.

* * * * *